US006945841B2

(12) United States Patent
Becker et al.

(10) Patent No.: US 6,945,841 B2
(45) Date of Patent: Sep. 20, 2005

(54) CUSTOMIZABLE DOLL WITH INTERCHANGEABLE FACES HAVING LIKENESS OF A PERSON

(76) Inventors: Rose Marie Becker, 364 CR 630, Oak Grove, AR (US) 72660; Regina Marie Morris, 62 CR 630, Oak Grove, AR (US) 72660; Frederick Walter Becker, Jr., 364 CR 630, Oak Grove, AR (US) 72660; Edmund Joseph Powers Becker, 364 CR 630, Oak Grove, AR (US) 72660; Frederick Walter Becker, III, 122 CR 630, Oak Grove, AR (US) 72660

( * ) Notice: Subject to any disclaimer, the term of this patent is extended or adjusted under 35 U.S.C. 154(b) by 0 days.

(21) Appl. No.: 10/431,123

(22) Filed: May 6, 2003

(65) Prior Publication Data

US 2004/0077274 A1 Apr. 22, 2004

Related U.S. Application Data

(60) Provisional application No. 60/378,314, filed on May 7, 2002.

(51) Int. Cl.[7] ..... A63H 3/16; A63H 3/36

(52) U.S. Cl. ..... 446/100; 446/92; 446/391

(58) Field of Search ..... 446/100, 139, 446/391, 99, 97, 92, 392; 434/100, 262, 267–270; 40/615–591, 618

(56) References Cited

U.S. PATENT DOCUMENTS

| | | | | | |
|---|---|---|---|---|---|
| 833,448 | A | | 10/1906 | De Vall et al. | |
| 2,199,049 | A | | 4/1940 | Greenburg | |
| 2,484,343 | A | | 2/1949 | Hawes | |
| 2,760,303 | A | | 8/1956 | Del Mas | |
| 2,831,286 | A | * | 4/1958 | Eisner | 249/112 |
| 3,090,155 | A | | 5/1963 | Gordon | |
| 3,106,041 | A | * | 10/1963 | Kahn | 446/327 |
| 3,464,146 | A | * | 9/1969 | McCurdy | 446/100 |
| 3,660,926 | A | * | 5/1972 | Lerner et al. | 446/73 |
| D226,772 | S | | 4/1973 | Ehrenreich | |
| 3,863,386 | A | | 2/1975 | Kinberg | |
| 4,020,586 | A | | 5/1977 | Benner | |
| 4,122,628 | A | | 10/1978 | Crowell et al. | |
| 4,659,319 | A | | 4/1987 | Blair | |
| 4,681,555 | A | * | 7/1987 | Natiw | 446/327 |
| 4,710,145 | A | * | 12/1987 | Hall Vandis | 446/100 |
| 4,776,823 | A | * | 10/1988 | Hanlon | 446/321 |
| 4,798,556 | A | * | 1/1989 | Vicars et al. | 446/391 |
| 4,808,139 | A | * | 2/1989 | Price | 446/75 |
| 4,874,345 | A | | 10/1989 | Dirks | |
| 4,979,924 | A | * | 12/1990 | Manger | 446/100 |
| 5,009,626 | A | * | 4/1991 | Katz | 446/391 |
| 5,041,050 | A | | 8/1991 | Ritchey et al. | |

(Continued)

*Primary Examiner*—Derris H. Banks
*Assistant Examiner*—Faye Francis
(74) *Attorney, Agent, or Firm*—Dara L. Onofrio, Esq.; Onofrio Law

(57) ABSTRACT

A doll having the likeness of a person or animal, wherein the doll form includes a body and head in the general shape of a human or animal is provided. The head includes a facial portion comprised of a first support having a receiving surface for receiving a face member. The face member is made of a second support having a transfer surface for transfer of facial features having the likeness of a particular person or animal. The first and second supports are compatible such that the face member is attached and secured to the receiving surface. The face member can be easily removed and changed with another face member having different facial features. Other exchangeable accessories, including hair and clothing, are used to customize the doll to become anyone so desired. The doll may also contain a voice recording mechanism to correlate to the voice of the individual whose facial features are on the face member. In an alternate embodiment the doll form is a hand or finger puppet.

31 Claims, 4 Drawing Sheets

U.S. PATENT DOCUMENTS 5,046,985 A 9/1991 Cearfoss
5,090,910 A * 2/1992 Narlo ..... 434/82
5,141,466 A 8/1992 Catizone
5,178,573 A * 1/1993 Smith ..... 446/73
5,215,493 A * 6/1993 Zgrodek et al. ..... 446/372
5,314,370 A 5/1994 Flint
5,348,510 A * 9/1994 DuPont et al. ..... 446/100
5,382,187 A 1/1995 Wilson
5,403,224 A 4/1995 Gintling
5,498,189 A 3/1996 Townsend
5,515,563 A * 5/1996 Chao ..... 5/632
5,803,788 A * 9/1998 Penberthy et al. ..... 446/391
5,862,615 A * 1/1999 O'Rourke ..... 40/1.6
5,947,791 A 9/1999 Taylor
6,099,378 A 8/2000 George et al.
6,099,379 A * 8/2000 Eppley ..... 446/392
6,120,340 A * 9/2000 Zaborowski ..... 446/100
6,183,338 B1 * 2/2001 Mallette ..... 446/337
6,280,283 B1 * 8/2001 Sisler ..... 446/100
6,422,871 B2 * 7/2002 Shepherd ..... 434/236
6,511,359 B1 1/2003 Lui
6,558,221 B1 5/2003 Yang

* cited by examiner

CUSTOMIZABLE DOLL WITH INTERCHANGEABLE FACES HAVING LIKENESS OF A PERSON

This application claims the benefit of U.S. provisional application No. 60/378,314 filed May 7, 2002, which is incorporated herein by reference.

FIELD OF THE INVENTION

The present invention relates generally to dolls, and more particularly to a customizable doll having exchangeable face members and hair. Specifically the doll form is a human or animal shape and includes a face member resembling the likeness of a person or animal can easily be removed and changed with another face member having different facial features.

BACKGROUND OF THE INVENTION

Dolls bring enjoyment to children of all ages through playing with them, and for their owners they often seem to take on their own personality. Further, dolls, and in particular, a set of dolls, sometimes become collector's items and gain value when collected as an entire set. The particular use for a doll (i.e., play or collect) is determined by the preference of the owner. For example, Cabbage Patch Kids® dolls and Beanie Babies® were purchased for enjoyment by some and for their potential future value by others (i.e., collectors).

In general, dolls may be constructed in many shapes and forms, including as cartoon characters, super heroes, celebrities and even ones providing customizable features (e.g., Mr. Potato Head®). However, even though these dolls can provide hours of enjoyment, they are usually "generic" and generally lack a personal character. Even when the facial features on these dolls are recognizable, they are typically of a well-known or famous figure. Further, these dolls generally do not provide for customization for a particular person.

U.S. Pat. No. 4,659,319 to Blair describes a process for making a three-dimensional doll face sculpture by using a photographically printed face module.

U.S. Pat. No. 5,009,626 to Katz discloses a process for making a three-dimensional doll head using a head sack made of a flexible sheet fabric material bearing an imprint (by a photograph) of the head portion of a real life subject. The head sack is filled with a molding material to make a three-dimensional head.

Use of photographs of an individual in a doll form is known in general. For example, U.S. Pat. No. 5,382,187 to Wilson discloses a doll imprinted on the fabric face surface with the photograph of an individual; U.S. Pat. No. 5,403,224 to Gintling describes a doll having a pocket secured to the face portion of the doll for displaying a photograph; U.S. Pat. No. 5,803,788 to Penberthy et al. discloses ceramic figurines with a picture image for a face; and U.S. Pat. No. 6,183,338 to Mallette describes a doll head with a recessed area where a sheet having facial characteristics can be inserted.

As described above, dolls that include photographs or likeness to a real life subject are either directly imprinted to the facial surface of the doll or are essentially picture frames in a doll shaped form that contain photographs. The present invention is an improvement over these dolls in that it provides of a customizable doll that is easily personalized and readily made into different dolls having different features as desired by the owner. It is desirable for such a doll to have the appearance, and in particular, the face or faces of a person known to the doll owner (e.g., grandchild, niece or nephew).

Also in contrast to the known art the invention doll encompasses creation of multiple dolls from the same doll form using interchangeable faces along with exchangeable accessories including hair and clothing.

It therefore is a general object of the invention to provide a customizable doll that has the likeness of a person, where the face of the doll has the likeness of that person. For example, the face may be of someone known to the doll owner or the recipient of the doll. Multiple exchangeable faces of the same family or related members can be prepared and the doll customized as desired to create a different doll using the same doll form.

Another object is to provide for transferring the picture of a person onto a face member and attaching to the face of a doll (e.g. rag doll). This face member is easily removed and exchanged with other different face members. Additional customizable elements include the shape of the doll (e.g., male or female), the hair characteristics of the doll (e.g., length and color) and a tag or label identifying the doll, which may include the name and birth date of the doll, which preferably corresponds to the person's face transferred onto the doll or attached to its body.

The face is preferably configured in the likeness of a living person with the identification information associated with that living person whose likeness is transferred to the face. The facial features of the doll can also be configured to provide a three-dimensional appearance.

The label is adapted for recording (e.g., in a blank space or line) the name and birth date of the doll and may have that name and birth date information preprinted thereon. Preferably, the name of the individual who constructed the doll is provided on the label. Accessories (e.g., necklace or earrings) for the doll also may be provided.

A more specific object of the invention is to provide a doll form including the body and head in the general shape of an animal. The facial features having the likeness of a particular person or animal is transferred to a face member that is then attached to the facial portion of the doll form.

Another more specific object of the invention is to provide a hand or finger puppet in the general shape of either a human or animal. The facial features having the likeness of a particular person or animal is transferred to a face member that is then attached to the facial portion of the doll form.

SUMMARY OF THE INVENTION

In general, the invention provides a doll having the likeness of a person. The doll body and head can be in the general shape of a human or animal.

In either embodiment the head includes a facial portion comprised of a first support having a receiving surface for receiving a face member. The face member is made of a second support having a transfer surface for transfer of facial features having the likeness of a particular person. Both the first and second support are compatible such that the face member is attached and secured to the receiving surface but can also be easily removed.

In a preferred embodiment both the first and second support surfaces are flat surfaces and are comprised of a magnetic material or an adhesive material or strips of fastening tape that permits attachment and removal of said face member from said facial portion.

In a most preferred embodiment the face member is comprised of a magnetic sheet having an adhesive on at least one surface.

According to the invention method the facial features of a particular person are imprinted on, preferably, a paper substrate, e.g. a photograph, digital image or photocopy, and are transferred to the transfer surface of the face member. The photograph, digital image or photocopy is adhered to the transfer surface and preferably, further covered by a protective laminated coating over the facial features.

In an alternate embodiment the photograph of a particular person is printed on transfer paper and transferred onto said transfer surface such that the facial features having the likeness of the particular person are transferred to said face member.

The invention also provides a means for attaching hair to the head of the doll which include an adhesive material, strips of fastening tape, snaps, buttons or other materials which permit attachment and removal of said hair from the head.

Other additional features of the invention include a label having identification information including birth date and name information thereon. The identification information can be placed on the face member surface opposite the surface having the facial features. In a preferred embodiment the identification information relates to the living person.

It is within the scope of the invention to configure the facial feature to provide a three-dimensional appearance.

In alternate embodiment, the doll form is a body and a head in the general shape of an animal. All the other elements of the invention are the same as described above. In this embodiment the facial features having the likeness of a particular animal or person is transferred to the transfer surface.

In yet another embodiment of the invention a hand or finger puppet is provided having the likeness of a person or animal. The hand or finger puppet form includes a head in the general shape of either a human or animal. The head includes a facial portion comprised of a first support having a receiving surface for receiving a face member. The face member also has a second support with a transfer surface for transfer of facial features having the likeness of a particular person or animal. The first and second support are compatible such that the face member is attached and secured to the receiving surface but is also easily removed.

The first and second support surfaces are flat surfaces and are preferably made of a magnetic material, an adhesive material or fastening strips that permit attachment and removal of the face member from the facial portion.

In a preferred embodiment the face member is made of a magnetic sheet having an adhesive on at least one surface. According to the invention, a photograph, digital image or photocopy, of the facial features, having the likeness of a particular person or animal, is transferred onto the transfer surface of the face member. The photograph, digital image or photocopy is adhered to said transfer surface. A protective laminated coating is provided over the facial features to further protect the image.

All the invention embodiments may include a voice recording mechanism that can be made to correlate to the voice of the person or animal whose facial features are on the doll. This voice recording mechanism can be housed within the doll itself, within a removable pouch on the doll form or within the dolls clothing, but is not limited to such.

Adhesive material, strips of fastening tape, snaps, buttons or other materials can be used to attach hair to the head of the hand or finger puppet. These means permit easy attachment and removal of said hair from the head. The facial features can also be configured to provide a three-dimensional appearance.

Other objects, features and advantages of the present invention will be apparent when the detailed description of the preferred embodiments of the invention are considered with reference to the drawings, which should be construed in an illustrative and not limiting sense as follows:

BRIEF DESCRIPTION OF THE DRAWINGS

FIG. 1(*b*) is an illustration of the components of the face member in accordance with the invention;

FIG. 1(*c*) is an illustration of the face member in accordance with the invention after the facial features having the likeness of a particular person have been transferred;

FIG. 1(*d*) is an illustration of an example of an interchangeable hair component in accordance with the invention;

FIG. 2(*b*) is an illustration of the components of the face member in accordance with the invention;

FIG. 2(*c*) is an illustration of the face member in accordance with the invention after the facial features having the likeness of a particular person has been transferred;

FIG. 2(*d*) is an illustration of the face member in accordance with the invention after the facial features having the likeness of a particular animal has been transferred;

DETAILED DESCRIPTION OF THE PREFERRED EMBODIMENTS

Figure 1A:
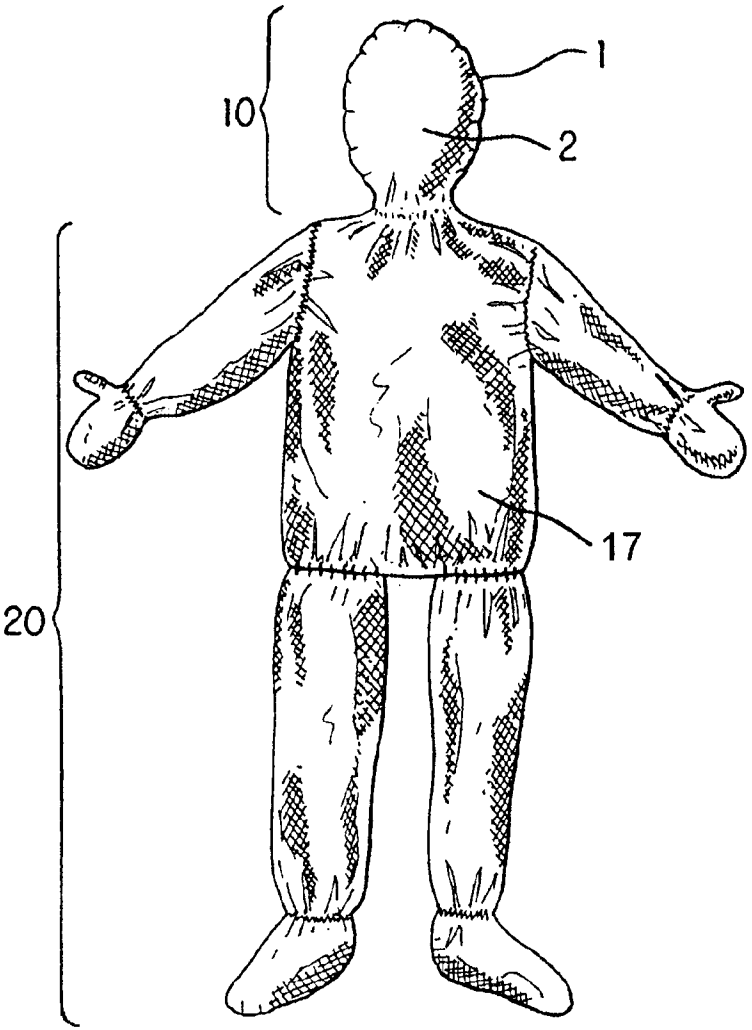
FIG. 1(*a*) is a basic view of the doll of the present invention having a body and head in the general shape of a human.
Figure 1D:
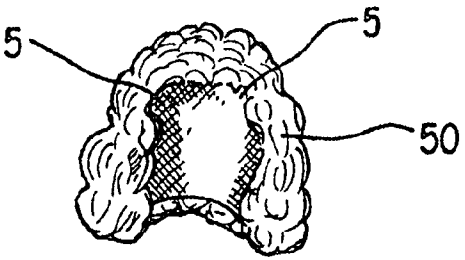
Figure 1B:
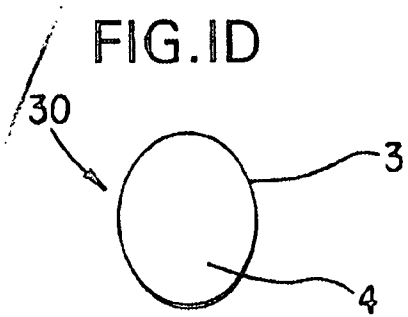
Figure 1C:
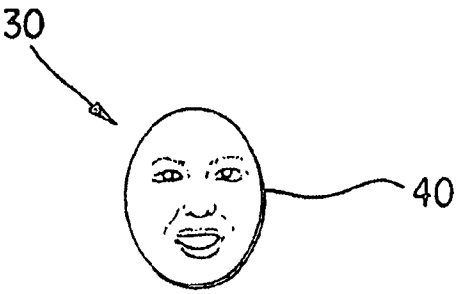
Figure 2B:
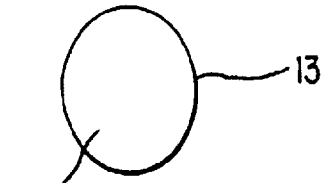
FIG. 2(*a*) is a basic view of the doll of the present invention having a body and head in the general shape of an animal, in particular a cat.
Figure 2C:
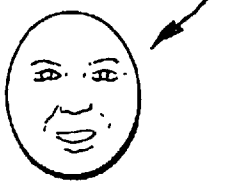
Figure 2D:
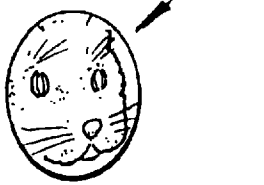
Figure 2A:
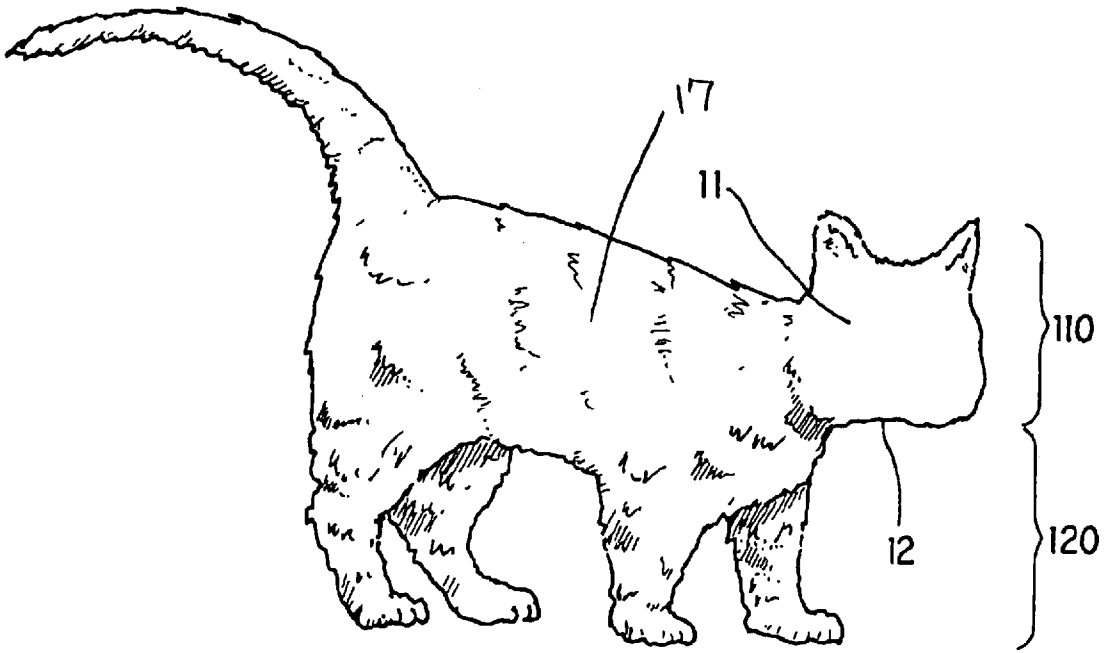

The following description of the preferred embodiments is merely exemplary in nature and is in no way intended to limit the invention, its application, or uses. Thus, although the present invention may be described in connection with a particular type of doll and a particular method for transferring a face onto the doll, it is not so limited, and other doll configurations and methods for transferring a face onto the doll are contemplated.

In general, a doll constructed according to the principles of the present invention provides for making multiple faces having the likeness of a individuals from the past, present or future, including, for example, the individual creating the doll. The simple method for creating a doll allows for years of enjoyment (e.g., see the likeness in generations of children in a family). A doll of the present invention may be used or given to someone that has never seen the actual person or persons whose faces have been transferred to face members and customized on the doll form (e.g., relative never seen before). Thus, dolls of the present invention provide enjoyment in use and may be collected (e.g., grandparents collecting dolls of all their grandchildren).

As shown in FIG. 1(*a*) the doll in accordance with the present invention is generally made of a facial portion 10 and a body portion 20 in the shape of a human. The facial portion is made of a first support 1 and has a receiving surface 2 for receiving a face member 30.

The face member 30 illustrated in FIG. 1(*b*) is made of a second support 3 having a transfer surface 4 for transfer of facial features having the likeness of a particular person. FIG. 1(*c*) is an illustration of what the face member looks like after the transfer of the facial features 40.

The first and second supports are preferably either oval or round in shape, although other shapes are within the scope of the invention, and are compatible with each other such that the face member is attached to the receiving surface. The invention provides that the face member is easily removed so as to permit customization of the doll into another embodiment using a different face member and accessories.

Preferably, the first and second support surfaces are flat surfaces and are both comprised of a magnetic material. The supports may also be comprised of an adhesive material or strips of fastening tape e.g. Velcro® that permits attachment and removal of the face member from the facial portion.

In a most preferred embodiment, the face member is made of a magnetic paper sheet having an adhesive on at least one surface. Magnetic sheets are commercially available and include a paper surface on one side and a magnetic material on the backside. The facial features of the individual is transferred to a paper substrate and adhered to the magnetic material. These sheets can be easily shaped as desired by cutting with a scissors.

The invention includes a variety of doll forms of different sizes and shapes and may be constructed of different materials (e.g., cloth, plastic or rubber) and component parts (e.g., stuffing for inside the doll).

With respect to transferring the facial features according to the principles of the present invention in general the following steps are performed with references being made to FIGS. 1(*a*), 1(*b*), 1(*c*) and 1(*d*):

1. Take a picture of a person (e.g., grandchild) to be transferred to the face member transfer surface 4 and adjust the picture size (i.e., enlarge or reduce) to the size of the transfer surface;

3. Copy the picture (e.g., using a copy machine) onto regular paper, transfer paper (e.g., transfer paper sold by Avery or Veinfang) or similar material;

4. Adhere to the printed image to the transfer surface using an adhesive material (eg. gluing);

5. Place the face member 40 with the printed image on receiving surface 2. Preferably a protective laminated coating is applied over the imprinted image to make the face member more durable;

6. Attach customized interchangeable hair 50 shown in FIG. 1(*d*) which may be constructed of any suitable material (e.g., yarn) to the doll head, e.g., by gluing or sewing a Velcro® fastener to the underside of the hair piece 5;

7. Dress the doll body, for example, using an outfit similar to one of the person whose picture has been transferred to the face of the doll; and 8. Attach (e.g., by gluing or sewing a Velcro® fastener) a tag or label onto the back of the face member or on the doll, for example, on a seam on a leg of the doll. The tag or label preferably includes a name and birth date of the doll (e.g., person whose face is on the doll) and the name of the doll maker (e.g., by Grandma).

In the preferred embodiment, multiple face members are provided for the doll. In particular, different pictures are copied onto paper. The pictures are then transferred to different removable face members for removable connection to the face of the doll. Construction of the doll again may be provided using steps as described above.

The removable face members may be removably connected to the face using any suitable connection member, including, for example, magnets or a Velcro® fastener. In a preferred embodiment, the first support is a magnet located behind or under the face portion and within the doll body. The second support of the removable face members preferably would also include a magnet on a back portion of each of the removable face members. It should be noted that the transfer surface 4 preferably is blank in this embodiment, but may include a picture transferred thereon (see FIGS. 1(*b*) and 1(*c*). Further, it should be noted that the face members may be constructed of any suitable material, including, for example, fabric or other material (e.g., paper), cardboard, or other generally rigid material, and may be laminated (e.g., using contact paper or heat sealant).

Although the invention was described above as transferring a photograph of facial features onto a face member, digital images or photocopies of the facial features can also be used. It should be noted that with respect to copying a picture onto paper or a similar transfer material, the copied image may be color or black and white. It further should be noted that an image (e.g., picture of a person) may be transferred to the face of the doll using other methods or procedures, including, for example, silk screening.

Further, the information provided on the tag or label may be preprinted thereon or spaces may be provided in which to write the information. It also should be noted that some of the steps described above maybe omitted, including for example, steps 7 and 8. Further, different steps may be performed by different individuals or performed in a different order as needed. For example, certain steps may be performed by the maker of the doll and certain steps performed by the recipient of the doll.

The first support 1 which is preferably under the facial portion material gives the facial portion a more smooth appearance and reduces the chance that the material forming the face becomes loose or otherwise altered or disfigured (e.g., wrinkled). Such a support member may be provided, for example, with a hard piece of plastic or cardboard attached under the face and preferably within the doll.

A doll of the present invention may be constructed based upon specific requirements (e.g., a specific order and sending a picture for use as face of doll) or a kit. The kit preferably includes a basic doll form (for example in different skin tone colors or shapes); materials for transfer of features to multiple magnetic face members, hair for the doll, which may be provided, for example, in different colors (e.g., brown, blonde and black), an outfit for the doll and a tag or label for identifying the doll.

It should be noted that the kit may include additional components or they may be provided separately. For example, books, including, for example, coloring books, based upon the dolls (e.g., with the faces copied onto the pages of the books) may be provided. Further, additional outfits (e.g., cheerleader or football player) or accessories (e.g., necklace or earrings) may be provided for the dolls. Also, a hand puppet or other figures having blank faces may be provided. A camera also may be included for taking a picture of a person whose face is to be transferred onto the doll.

Removable face members, which may be constructed, for example, using material having a back portion that includes one or more magnets or a Velcro® fastener for removable connection to the face may be provided. In this construction, the second support 3 includes one or more magnets behind or under the transfer surface 4 and/or a Velcro® fastener on the receiving surface 2 (i.e., on the front of the facial portion).

It should be noted that the receiving surface 2 maybe provided (e.g. on the facial portion) with any suitable material to allow for connection of the removable face members using the magnets, including, for example different metals (e.g., metal plate). The removable face members are preferably constructed slightly smaller in dimension than the receiving surface of the facial portion.

Figure 3:
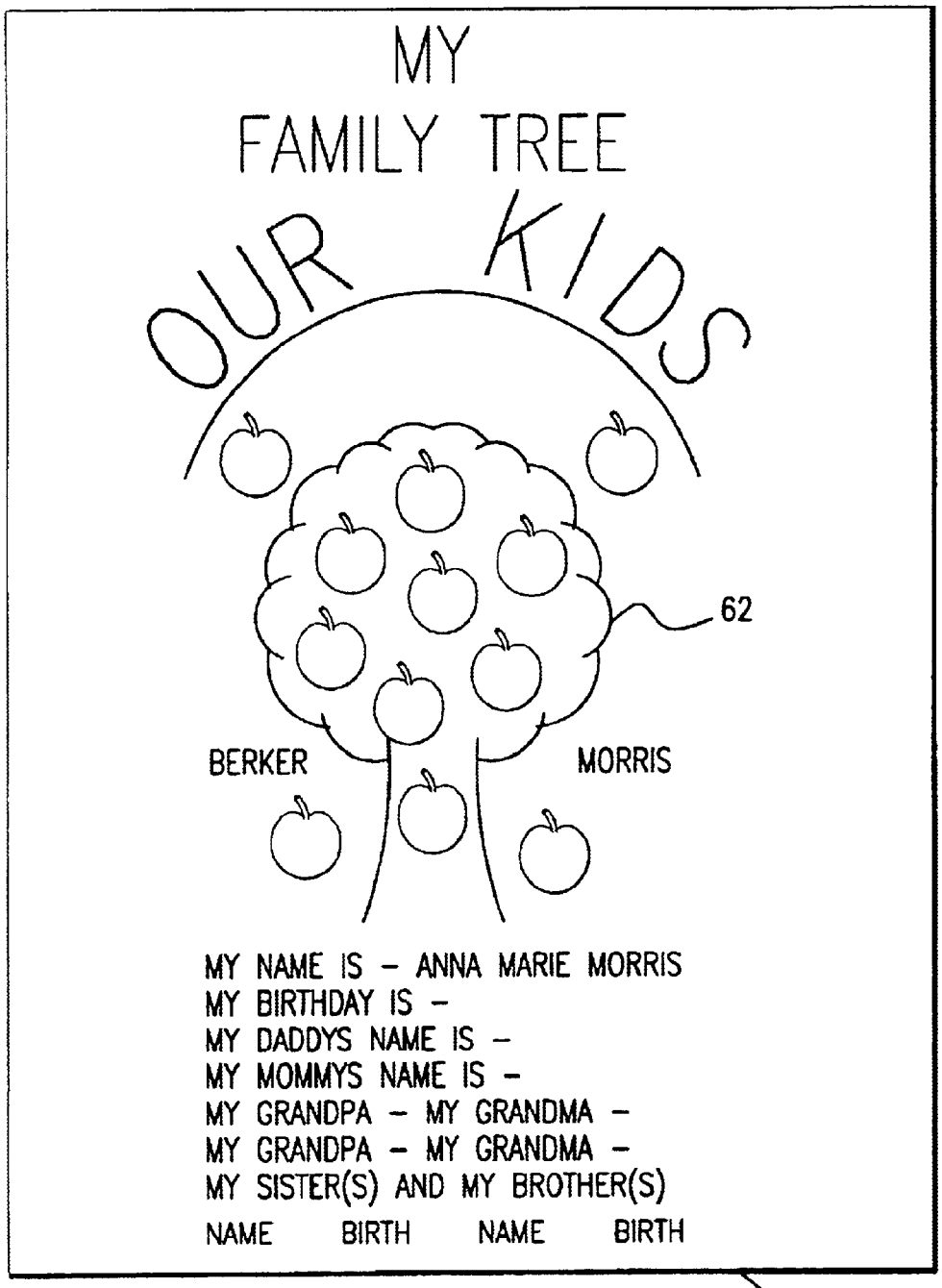
FIG. 3 is a representation of a sample certificate of the present invention.
Figure 4:
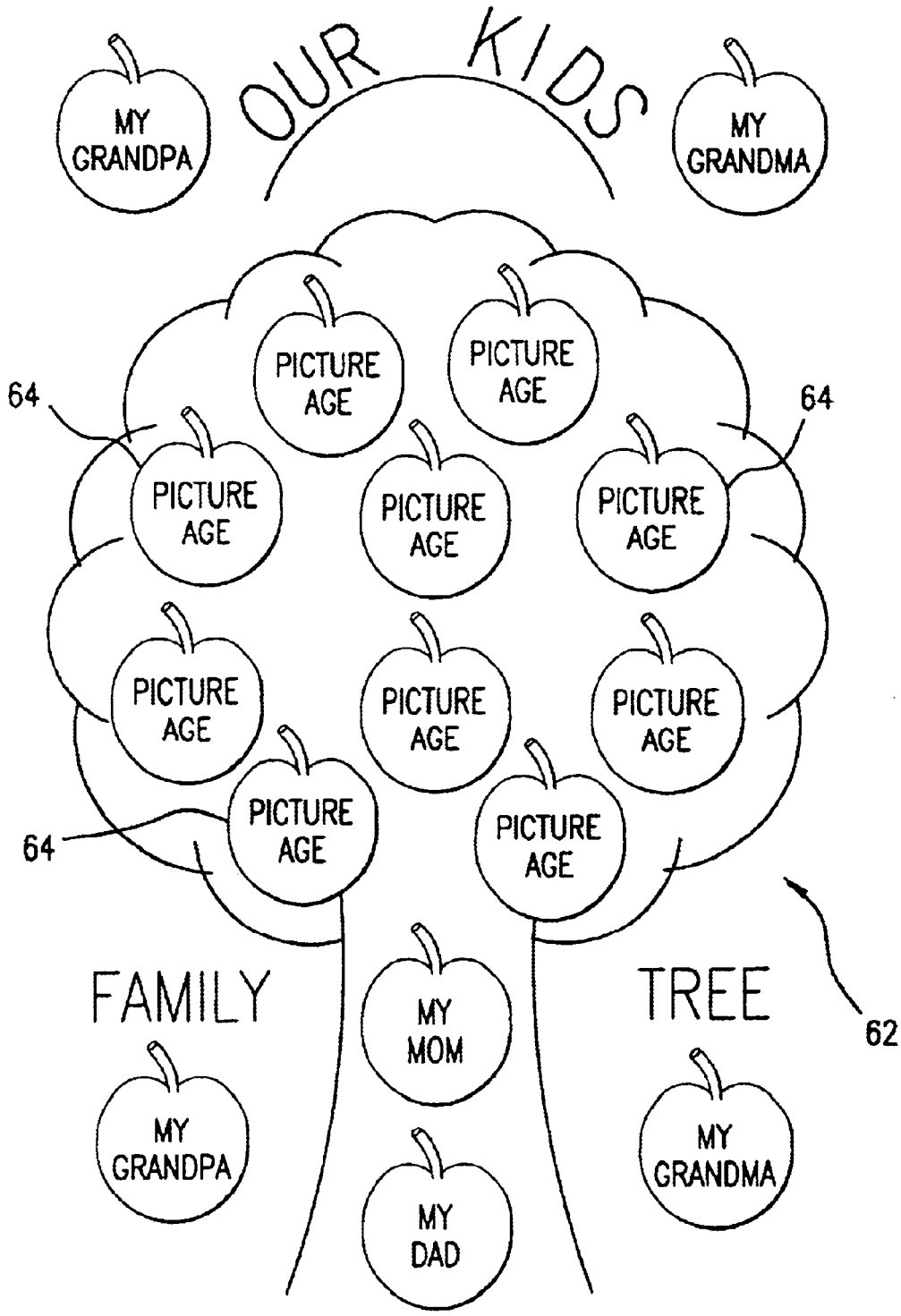
FIG. 4 is a schematic representation of a family tree of the certificate of FIG. 3.

Additionally, and as shown in FIGS. 3 and 4, a certificate 60 may be provided that includes a family tree 62. In particular, the family tree 62 may include a family history for the doll owner and may include pictures 64 of other family members, along with specific information (e.g., name and age of each family member).

It also should be noted that some of the components of the kit may be omitted and provided by the individual constructing the doll. For example, the hair and outfit may be provided by the maker of the doll to further personalize the doll.

In another embodiment of the invention illustrated in FIG. 2(*a*), a doll having the likeness of an animal is provided. The illustration shows the doll form in the shape of a cat but any other animal shape such as a dog, bird, cow, etc. is within the invention. The doll form includes a body 120 and a head in the general shape of an animal. The head includes a facial portion 110 made of a first support 12 having a receiving surface 11 for receiving a face member 130. In FIG. 2(*b*) the face member is shown to be made of a second support 13 having a transfer surface 14 for transfer of facial features. The first support and said second support are compatible such that the face member is attached to said receiving surface.

The facial features having the likeness of a particular animal FIG. 2(*d*) or person FIG. 2(*c*) is transferred to the transfer surface 14. A protective laminated coating is preferably provided over the facial features to provide more durability.

The first and second supports are preferably comprised of a magnetic material, an adhesive material or strips of fastening tape (e.g. Velcro®) which permits attachment and removal of the face member from the facial portion.

In a most preferred embodiment the face member is comprised of a magnetic sheet having an adhesive on at least one surface.

In yet another embodiment of the invention a hand or finger puppet having the likeness of a person or animal is provided. As used herein, the terms hand and finger puppet are used interchangeable to refer to the same embodiment, the only distinction between them being that the hand puppet fits on an individual's hand and the finger puppet fits on the individual's finger.

The puppet form includes a head in the general shape of either a human or animal. The head includes a facial portion comprised of a first support having a receiving surface for receiving a face member. The face member is made of a second support having a transfer surface for transfer of facial features having the likeness of a particular person or animal. The first support and second support are compatible such that the face member is attached to the receiving surface. The face member is easily removed.

The first and second support surfaces are preferably flat surfaces and are comprised of a magnetic material, an adhesive material or fastening strips, e.g. Velcro® which permits attachment and removal of the face member from the facial portion.

Preferably the face member is made of a magnetic sheet having an adhesive on at least one surface. As in the other previously described embodiments, a photograph, digital image or photocopy, of the facial features having the likeness of a particular person or animal, is transferred onto said transfer surface of the face member. The photograph, digital image or photocopy is adhered to the transfer surface and preferably a protective laminated coating is provided over the facial features.

The hand puppet can further include interchangeable hair attached to the head of the puppet using an adhesive material, strips of fastening tape (e.g. Velcro®), snaps, buttons or other materials which permit attachment and removal of said hair from the head. Thee facial features can also be configured to provide a three-dimensional appearance.

Thus, different dolls may be constructed having different faces transferred thereon. The construction of the doll allows for flexibility in design. Further, the use of paper to provide a face for the doll from a picture creates three-dimensional looking facial characteristics. Constructing dolls according to the present invention also allows for having a set of dolls representing a particular group of people (e.g., a family). However, the present invention is not limited to constructing dolls having faces of people in a particular family, but can be the face of any person whose picture is transferred onto the interchangeable face member.

Numerous variations are contemplated to be within the scope of the invention including incorporation of a voice recording mechanism housed within or on the doll body or attached to the doll accessories. This voice recording mechanism can be customized to correlate to the voice of the person or animal on the face member of the doll.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention as set forth in the following claims.

What is claimed is:

1. A doll having the likeness of a person, the doll comprising:

a doll form including a body and a head in the general shape of a human;

said head includes a facial portion comprised of a first support having a receiving surface; and a face member being comprised of a second support made of a magnetic sheet having an adhesive on at least one surface for transfer of facial features having the likeness of a particular person;

wherein said first support and said face member are compatible such that said face member is attached to said receiving surface.

2. The doll according to claim 1, wherein said face member is easily removed from said receiving surface.

3. The doll according to claim 1, wherein said first support and said face member are fiat surfaces.

4. The doll according to claim 1, wherein said first support is a magnetic material.

5. The doll according to claim 1, wherein a photograph, digital image or photocopy of said facial features, having the likeness of a particular person, is transferred onto said face member.

6. The doll according to claim 5, wherein the photograph, digital image or photocopy is adhered to said adhesive.

7. The doll according to claim 6, further comprising a protective laminated coating over said facial features.

8. The doll according to claim 1, wherein a photograph of a particular person is printed on paper and transferred onto said face member such that the facial features having the likeness of the particular person are transferred to said face member.

9. The doll according to claim 1 further comprising a means for attaching hair to the head of the doll.

10. The doll according to claim 9, wherein said means for attaching hair includes an adhesive material, strips of fastening tape, snaps or buttons which permit attachment and removal of said hair from the head.

11. The doll according to claim 1, further comprising a label having identification information including birth date and name information thereon.

12. The doll according to claim 11, wherein the identification information is on said face member surface opposite the surface having said facial features.

13. The doll according to claim 12 wherein said face member includes on one surface the facial features having the likeness of a living person and on the opposite surface said identification information that relates to the living person.

14. The doll according to claim 1 wherein said facial features are configured to provide a three-dimensional appearance.

15. The doll according to claim 1, further including a voice recording mechanism.

16. A doll having the likeness of an animal, the doll comprising:

a doll form including a body and a head in the general shape of an animal;

said head includes a facial portion comprised of a first support having a receiving surface; and a face member being comprised of a second support made of a magnetic sheet having an adhesive on at least one surface for transfer of facial features;

wherein said first support and said face member are compatible such that said face member is attached to said receiving surface.

17. The doll according to claim 16, wherein said facial features have the likeness of a particular animal or person and is transferred to said face member.

18. The doll according to claim 16, further comprising a protective laminated coating over said facial features.

19. The doll according to claim 16, wherein said first support is comprised of a magnetic material.

20. The doll according to claim 16, wherein magnetic sheet further has an adhesive on at least one surface.

21. A hand puppet having the likeness of a person or animal, the puppet comprising:

a hand puppet form including a head in the general shape of either a human or animal;

said head includes a facial portion comprised of a first support having a receiving surface; and a face member being comprised of a second support made of a magnetic sheet having an adhesive on at least one surface for transfer of facial features having the likeness of a particular person or animal;

wherein said first support and said face member are compatible such that said face member is attached to said receiving surface.

22. The hand puppet according to claim 21, wherein said face member is easily removed.

23. The hand puppet according to claim 21, wherein said first support and said face member are flat surfaces.

24. The hand puppet according to claim 21, wherein said first support is comprised of a magnetic material.

25. The hand puppet according to claim 21, wherein a photograph, digital image or photocopy, of said facial features having the likeness of a particular person or animal, are transferred onto said face member.

26. The hand puppet according to claim 25, wherein the photograph, digital image or photocopy is adhered to said adhesive.

27. The hand puppet according to claim 26, further comprising a protective laminated coating over said facial features.

28. The hand puppet according to claim 21, further comprising a means for attaching hair to the head of the puppet.

29. The hand puppet according to claim 28, wherein said means for attaching hair includes an adhesive material, strips of fastening tape, snaps or buttons which permit attachment and removal of said hair from the head.

30. The hand puppet according to claim 21, wherein said facial features are configured to provide a three-dimensional appearance.

31. A doll having the likeness of a person, the doll comprising:

a doll form including a body and a head in the general shape of a human;

said head includes a facial portion comprised of a first support having a flat receiving surface; and a face member comprised of a second support having an adhesive on one surface for transfer of facial features having the likeness of a particular person and an opposite surface having an adhesive material or strips of fastening tape which permits attachment and removal of said face member from said receiving surface;

wherein a photograph, digital image or photocopy of said facial features is transferred onto said transfer surface of said face member.

* * * * *